United States Patent [19]

Lewis, Jr.

[11] Patent Number: 4,958,164

[45] **Date of Patent: * Sep. 18, 1990**

[54] LOW PROFILE, BROAD BAND MONOPOLE ANTENNA

[75] Inventor: John R. Lewis, Jr., Chapin, S.C.

[73] Assignee: Shakespeare Company, Newberry, S.C.

[ * ] Notice: The portion of the term of this patent subsequent to Dec. 26, 2006 has been disclaimed.

[21] Appl. No.: 351,652

[22] Filed: May 15, 1989

Related U.S. Application Data

[63] Continuation of Ser. No. 849,884, Apr. 9, 1986, Pat. No. 4,890,116.

[51] Int. Cl.[5] ..... H01Q 9/00

[52] U.S. Cl. ..... 343/749; 343/722; 343/860

[58] Field of Search ..... 343/722, 749, 750, 752, 343/850, 860, 862, 865

[56] References Cited

U.S. PATENT DOCUMENTS

| | | | |
|---|---|---|---|
| 3,950,757 | 4/1976 | Blass | 343/791 |
| 4,086,596 | 4/1978 | Gauss et al. | 343/749 |
| 4,238,799 | 12/1980 | Parfitt | 343/749 |
| 4,238,800 | 12/1980 | Newington | 343/749 |
| 4,328,501 | 5/1982 | De Santis et al. | 343/749 |
| 4,466,003 | 8/1984 | Royce | 343/826 |
| 4,513,338 | 4/1985 | Goodall et al. | 343/749 |

FOREIGN PATENT DOCUMENTS

| | | |
|---|---|---|
| 129835 | 2/1978 | German Democratic Rep. . |
| 281762 | 12/1927 | United Kingdom . |
| 2148604A | 5/1985 | United Kingdom . |
| 2148605A | 5/1985 | United Kingdom . |
| 2171258A | 8/1986 | United Kingdom . |

OTHER PUBLICATIONS

The American Radio Relay League, *The ARRL Antenna Book*, pp. 102–103, 180–182 (13th Edition, 1974).

Joseph M. Boyer, *The Multi-Band Trap Antenna*, Part I, CQ, pp. 26–30, 73–74 (Feb. 1977); Part II, CQ, pp. 51–55, 74 (Mar. 1977);

Part III, CQ, pp. 46–50, 72 (Apr. 1977); Part IV, CQ, pp. 22–27 (May 1977).

Helmut Brueckman, *A New Approach To Broadband Vehicular Antennas, 1958 IRE National Convention Record*, Part 8, pp. 19–27.

Byron Goodman, *The Radio Amateur's Handbook*, pp. 49, 487–491 (40th Edition, 1963).

Gerald L. Hall, *The ARRL Antenna Book*, pp. 4–8–4–11, 5–21–5–22 (14th Edition, 1983).

Ben Halpern, et al., *Broadband Whip Antenna For Use in HF Communications, APS International Symposium Digest–1985 Antennas and Propogations*, vol. 1, pp. 763–767 (Jun. 17–21, 1985).

Indiana General, *Broad-Band Balum Transformers*, Indiana General Technical Bulletin, reprinted from OST, Aug. 1964.

Henry Jasik, *Antenna Engineering Handbook*, pp. 2–4–6–2–51, 3–1–3–7, 31–4–31–5 (1st Edition, 1961).

Richard C. Johnson & Henry Jasik, *Antenna Engineering Handbook*, pp. 14–1–14–3, 14–38–14–44 (2nd Edition, 1984).

John A. Keucken, *Antennas and Transmission Lines*, pp. 244–253 (1969).

C. L. Ruthroff, *Some Broad-Band Transformers*, Proc. IRE, vol. 47, pp. 1337–1342 (Aug. 1959).

Warren L. Stutzman & Gary A. Thiele, *Antenna Theory And Design*, pp. 260–261, 280–281 (1981).

R. F. Treharne, *Multipurpose Whole-Band HF Antenna Architecture*, Journal of Electrical and Electronics Engineering, Australia, vol. 3, No. 2, pp. 141–152 (Jun. 1983).

*Primary Examiner*—William L. Sikes

*Assistant Examiner*—Robert E. Wise

*Attorney, Agent, or Firm*—Renner, Kenner, Greive, Bobak, Taylor & Weber

[57] ABSTRACT

A low-profile, broad band monopole antenna (10) includes two linear radiators (11,13), a resistor network (18), and a transmission line network (20), all connected in series in that order. Linear radiator (11) includes a capacitor (12) which reduces the apparent electrical length of the antenna and provides high voltage isolation. Resistor network (18) reduces VSWR at lower frequencies in the band of interest such that in combination with the other elements, the VSWR for antenna (10) is sufficiently low that no further matching or tuning is necessary over the entire broad frequency band of interest without significant loss of gain relative to that of a monopole antenna one-quarter wave resonant at each frequency throughout the frequency band of interest.

2 Claims, 8 Drawing Sheets

LOW PROFILE, BROAD BAND MONOPOLE ANTENNA

This is a continuation of Ser. No. 849,884, filed Apr. 9, 1986, now U.S. Pat. No. 4,890,116.

TECHNICAL FIELD

The present invention relates generally to a low profile antenna More particularly, the present invention relates to a low profile monopole antenna having inherent low VSWR and high gain characteristics over a broad range of frequencies, for example 30 MHz to 90 MHz.

BACKGROUND ART

Many of the numerous communications services which utilize the radio frequency portion of electromagnetic spectrum each operate over one or more broad ranges of frequencies, including aeronautical mobile (3–23 MHz), amateur radio (2–30 MHz), government (25–50 MHz and 30–90 MHz), land mobile (2–50 MHz), and marine mobile (3–22 MHz), to name a few. Heretofore antennas for such services operating in bands from very-low frequencies ("VLFs") through the low end of ultra-high frequencies ("UHFs") either had to be changed for every different narrow range of frequencies, or manually or electronically rematched and/or retuned so that the antenna would have acceptable operating characteristics such as low VSWR and high gain over the entire frequency range of interest. These characteristics were particularly difficult to achieve in mobile applications where antennas had to be strong, light-weight, easy to use and of low-profile.

One such well known, broad band vertically polarized monopole mobile antenna, designed for use with frequencies from about 30 MHz to 76 MHz, is disclosed in the article by Helmut Brueckmann entitled "A New Approach to Broadband Vehicle Antennas", 1958 IRE National Convention Record. Part 8, pages 19–27. The impedance of this antenna varies so widely over these frequencies that four separate matching and tuning circuits, manually switched in and out by the user, must be employed to tune the antenna.

Recently electromagnetic communication systems have begun to employ broad bandwidth techniques, such as the so-called frequency-agile or frequency-hopping systems in which both the transmitter and receiver rapidly and frequently change communication frequencies within a broad frequency spectrum in a manner known to both units. When operating with such systems, antennas having multiple matching and/or tuning circuits that must be switched, whether manually or electronically, with the instantaneous frequency used for communications, are simply inadequate. Instead, it is imperative to have a single antenna reasonably matched and tuned at all frequencies throughout the broad frequency spectrum of interest.

DISCLOSURE OF THE INVENTION

It is, therefore, an object of the present invention to provide a single, low-profile antenna suitable for use throughout a broad band of frequencies without any need for rematching and retuning.

It is another object of the present invention to provide a low-profile antenna, as above, that is suitable for rugged mobile use, including electrical isolation of any radiator element most likely to engage a high voltage power conductor.

It is still another object of the present invention to provide a low-profile antenna, as above, having radiation efficiencies throughout the broad band of frequencies of interest at least approximating that of a one-quarter wavelength monopole antenna.

These and other objects and advantages of the present invention over existing prior art forms will become more apparent and fully understood from the following description in conjuction with the accompanying drawings.

In general, a low-profile, monopole broad band antenna embodying the concept of the present invention would include a radiator, a resistor network and a transmission line network. The radiator includes a series capacitance and is operatively connected to the transmission line network. The resistor network is electrically connected in series with the radiator, providing an antenna with sufficiently low VSWR over its broad band that matching and tuning is unnecessary and gain approximates that of a one-quarter wavelength monopole antenna over substantially all frequencies in the broad band.

PREFERRED EMBODIMENT FOR CARRYING OUT THE INVENTION

Figure 1:
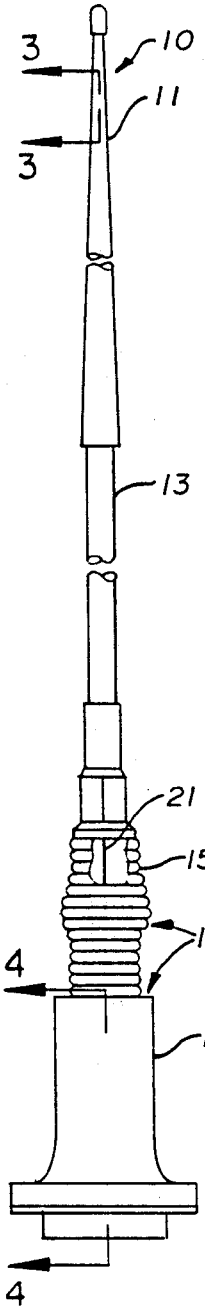
FIG. 1 is an elevational view of an exemplary antenna according to the concept of the present invention.

FIG. 1 depicts an exemplary monopole antenna embodying the concept of the present invention, which is generally indicated by the numeral 10. Antenna 10 includes an upper or tip linear radiator section 11 (called "tip radiator 11") within which is embedded a tip capacitor 12 (shown schematically in FIG. 2), a lower or base linear radiator section 13 (called "base radiator 13") and a base assembly 14.

Both tip radiator 11 and base radiator 13 may be generally formed in a manner conventional for low profile, high mechanical strength monopole applications: a tapered cylindrical core made of a non-conductive material such as fiber reinforced plastic may be wrapped by a braid of conductors and enclosed within a fiberglass or plastic cover laminate A mating ferrule (not shown), made of suitable conductive material such as brass, may be inserted in the base of tip radiator 11 and the top of base radiator 13 to permit their electrical and mechanical engagement.

Figure 3:
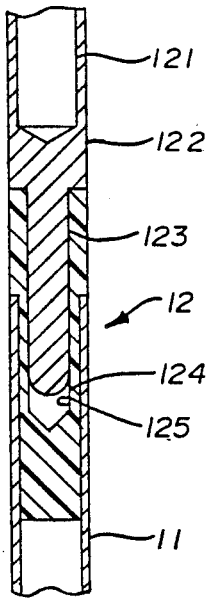
FIG. 3 is a partial vertical fragmentary view taken substantially along the line 3—3 of FIG. 1 showing particularly an exemplary tip capacitor assembly.

One possible construction of tip capacitor 12 may be described by reference to FIG. 3. At an elevation above ground to be discussed hereinafter, the core of tip radiator 11 (identified by the numeral 121) has secured to it by bonding or other methods as would occur to the skilled artisan a cylindrical conductive fitting 122 having a cylindrical finger 123 of slightly smaller diameter than that of core 121. Finger 123 rests inside a non-conductive dielectric spacer 124, such as made of Teflon adapted to receiving finger 123 in bore 125 and is itself secured to the continuing lower portion of tip radiator 11. It will be appreciated that the capacitance of tip capacitor 12 may be adjusted by the extent to which finger 123 extends inside the continuing lower portion of tip radiator 11. It is also significant to note that as a result of the incorporation of tip capacitor 12 within and in series with tip radiator 11, antenna 10 includes an appreciable safety factor — antenna 10 will not break down upon contact with a high voltage power line until tip capacitor 12 and the fiberglass cover surrounding it reach their breakdown voltage — which has been found to be greater than 25 KV for the antenna configuration specified hereinafter.

Figure 2:
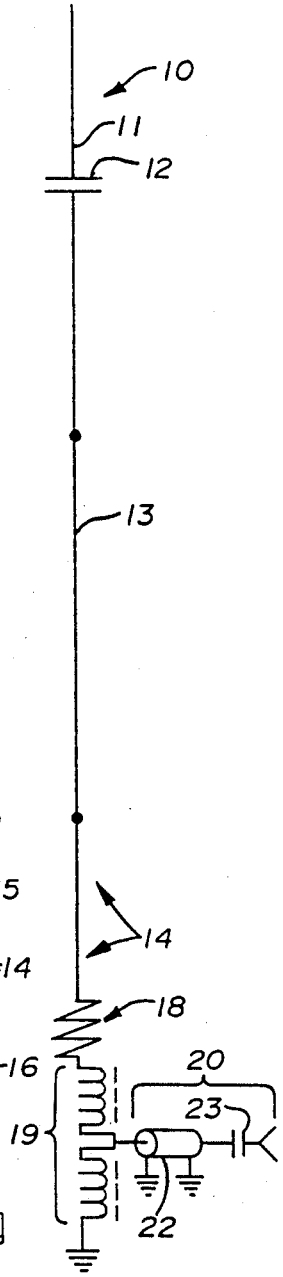
FIG. 2 is a schematic diagram of the lumped-circuit electrical mode for the exemplary antenna depicted in FIG. 1.
Figure 4:
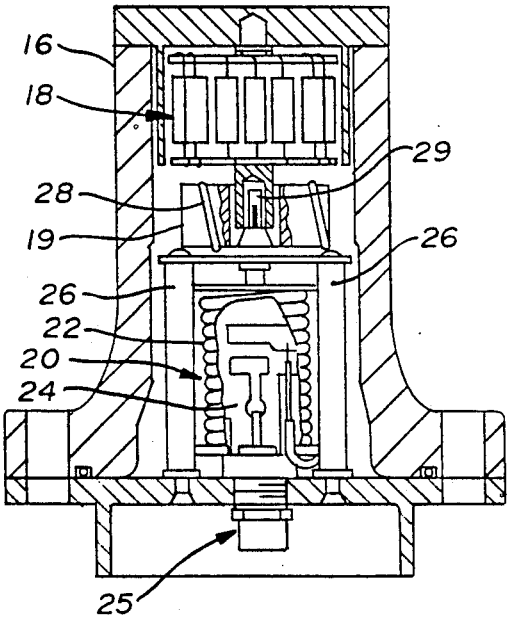
FIG. 4 is a partial vertical fragmentary view taken substantially along the line 4—4 of FIG. 1 showing particularly an exemplary arrangement of components housed within the base insulator assembly including the resistor assembly, impedance transformer and matching network.

Base assembly 14, includes spring 15 and, as best seen in FIG. 4 and schematically in FIG. 2, a cylindrical base housing 16 containing resistor assembly 18, impedance transformer 19 and transmission line network 20. Spring 15, preferably made of corrosion-resistant steel, may have one of its ends electrically and mechanically connected with the base of base radiator by mating ferrule (not shown), may have its opposite end fastened such as by bolting to base housing 16, and preferably has its two ends electrically shorted by shorting braid conductor 21 (illustration in FIG. 1). Resistor assembly 18 may include a plurality of resistors connected in parallel or other circuit configuration whose lumped-circuit resistance is as hereinafter described and whose power ratings suffice to provide adequate dissipation for the maximum real power to be dissipated by antenna 10. Impedance transformer 19 is a fixed impedance ratio, toroidal, broad band coupling transformer similar to that described in *The ARRL Antenna Book,* 14th Edition (1983) at pages 4–8 through 4–11 and 5–21 through 5–22, and the article by C. L. Ruthroff entitled "Some Broad-Band Transformers", *Proceedings of the IRE* (1959) at pages 1337 through 1342. Transmission line network 20 includes a length of coaxial transmission line 22 and a matching capacitor 23, which may be one or more capacitors connected in parallel or other circuit configuration whose lumped-circuit capacitance is as hereinafter described.

In order to achieve a compact base housing, it has been found desirable to coil and place transmission line 22 coaxial with the vertical (and longitudinal) axis and at the base of base housing 16, surrounding a small printed circuit board 24 carrying matching capacitor 23. The center conductor from one end of the coaxial transmission line 22 is electrically connected to the small printed circuit board 24 and one end of matching capacitor 23. The other end of matching capacitor 23 may be electrically connected through printed circuit board 24 to the center-lead of any connector, such as BNC connector 25, suitable for facilitating quick electrical and mechanical connection to a transmission line (not shown) or other means for coupling antenna 10 to the desired transmitter/receiver. The shield conductor from the end of the transmission line 22 is electrically connected through printed circuit board 24 to the shield of BNC connector 25.

Standoffs 26 secure transmission line network 20 in place and carry impedance transformer 19 thereatop, which transformer 19 has the two leads 28 of its winding electrically connected to the end of the coaxial transmission line 22 opposite that end connected to printed circuit board 24. A banana plug 29 or other appropriate conductive connector also is carried atop standoffs 26 for electrical and mechanical engagement with a mating plug in the base of the resistor assembly 18. Where resistor assembly 18 is formed of a plurality of resistors electrically connected in parallel between two circular conductive plates one of which has connected thereto the banana plug mate and the opposite plate of which electrically engages the base of shorting braid capacitor 21 for spring 15, the skilled artisan will appreciate that resistor network 18, impedance transformer 19, transmission line 22 and matching capacitor 23 are electrically connected in series as depicted schematically in FIG. 2.

Having described the mechanical and electrical configuration of antenna 10, the specific parameters of its elements as utilized in the preferred form suitable for use in the frequency range of 30 MHz - 90 MHz whose operation and performance is detailed hereinafter are as follows:

| Physical Lengths: | |
|---|---|
| Overall | 117" (297.2 cm) |
| Tip Radiator | 58.25" (148.0 cm) |
| Base Radiator | 51.25" (130.2 cm) |
| Tip Capacitor to Ground | 65.50" (166.4 cm) |
| Tip Capacitance: | 5 pf |
| Resistor Assembly: | Twelve 220 ohm 2W resistors in parallel |
| Effective Resistance: | 18.33 ohm |

-continued

| | |
|---|---|
| Impedance Transformer: | 3.56:1 fixed Impedance Ratio; Two conductors of 11" (27.9 cm) and 15.25" (38.7 cm) lengths wound around toroid core having 0.97" I.D. (2.5 cm), 1.54" O.D. (3.9 cm) and made of Ferrite #67 nickel-zinc, having permeability 40 |
| Matching Capacitor: | Two 180 pf capacitors in parallel |
| Effective Capacitance | 360 pf |
| Transmission Line Inductance: | 45" (114.3 cm) of R316/U coax wound with 10 turns in coil having 1.47" (3.7 cm) diameter |

The operation of an antenna in accordance with the concept of the present invention may best be appreciated by reference to several plots, in the form of a simplified Smith Chart having 50 ohm characteristic impedance, of the impedance of antenna 10 over the broad range of frequencies of interest as variations are made in certain elements therein.

Figure 5:
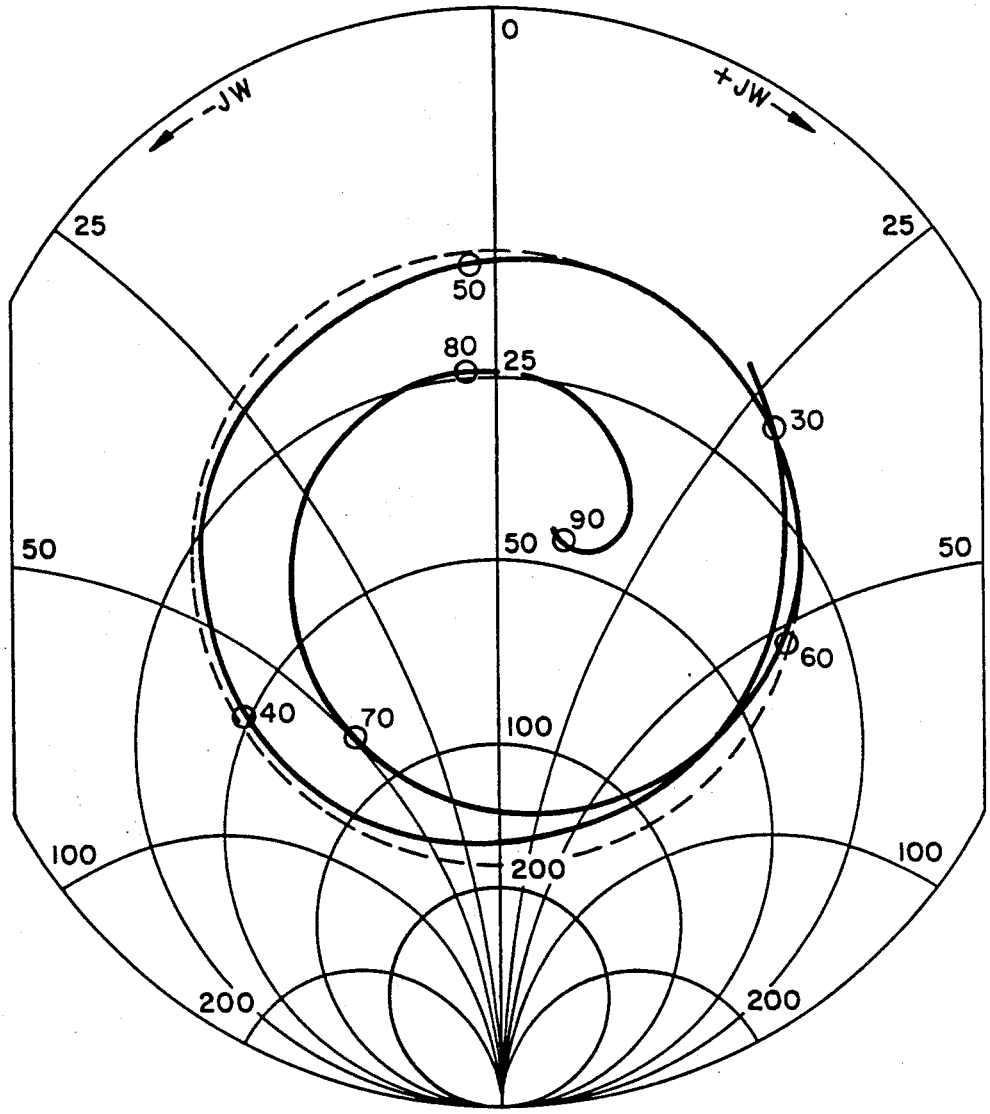
FIG. 5 is a plot, in the form of a simplified Smith Chart having 50 ohm characteristic impedance, of the measured impedance of the antenna depicted in FIG. 1 over the frequency range of approximately 30 MHz to 90 MHz The 3.5:1 VSWR circle is drawn in dashed line on the plot of FIG. 5. The impedance was measured with the antenna having an overall physical height of 117 inches (297.2 cm) placed at the center of a 10′×10′ (3.0 m×3.0 m) ground plane.
Figure 6:
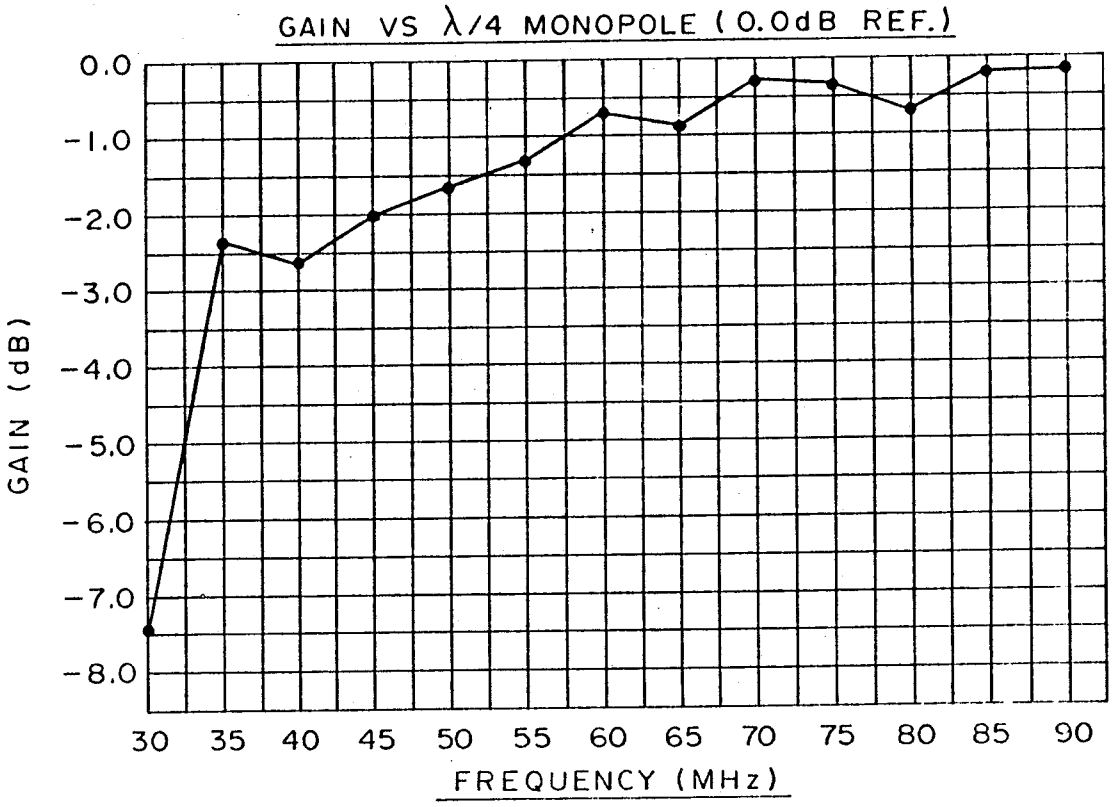
FIG. 6 is a plot of the gain of the antenna depicted in FIG. 1 relative to that of a one-quarter wavelength monopole antenna referenced to 0.0 dB over the frequency range of approximately 30 MHz to 90 MHz.

FIG. 5 presents a plot (commonly known as a Smith Chart) of the impedance of antenna 10 (having the specific parameters described above) as measured with antenna 10 placed vertically at the center of a 10'×10' (3.0×3.0 m) ground plane. As can be seen, such an antenna will operate from substantially 30 MHz through 90 MHz with a VSWR of 3.5:1 or less, entirely eliminating the need to otherwise match or tune the antenna. Moreover, as is apparent from FIG. 6, which depicts the gain of this embodiment of antenna 10 relative to that of a monopole antenna whose apparent electrical length at each frequency is one-quarter wavelength and whose gain is referenced to 0.0 dB at all frequencies, this low VSWR is achieved without significant loss in gain (which is −2.5 dB or less for all but the lowest 7% of the frequency band of interest).

Figure 7:
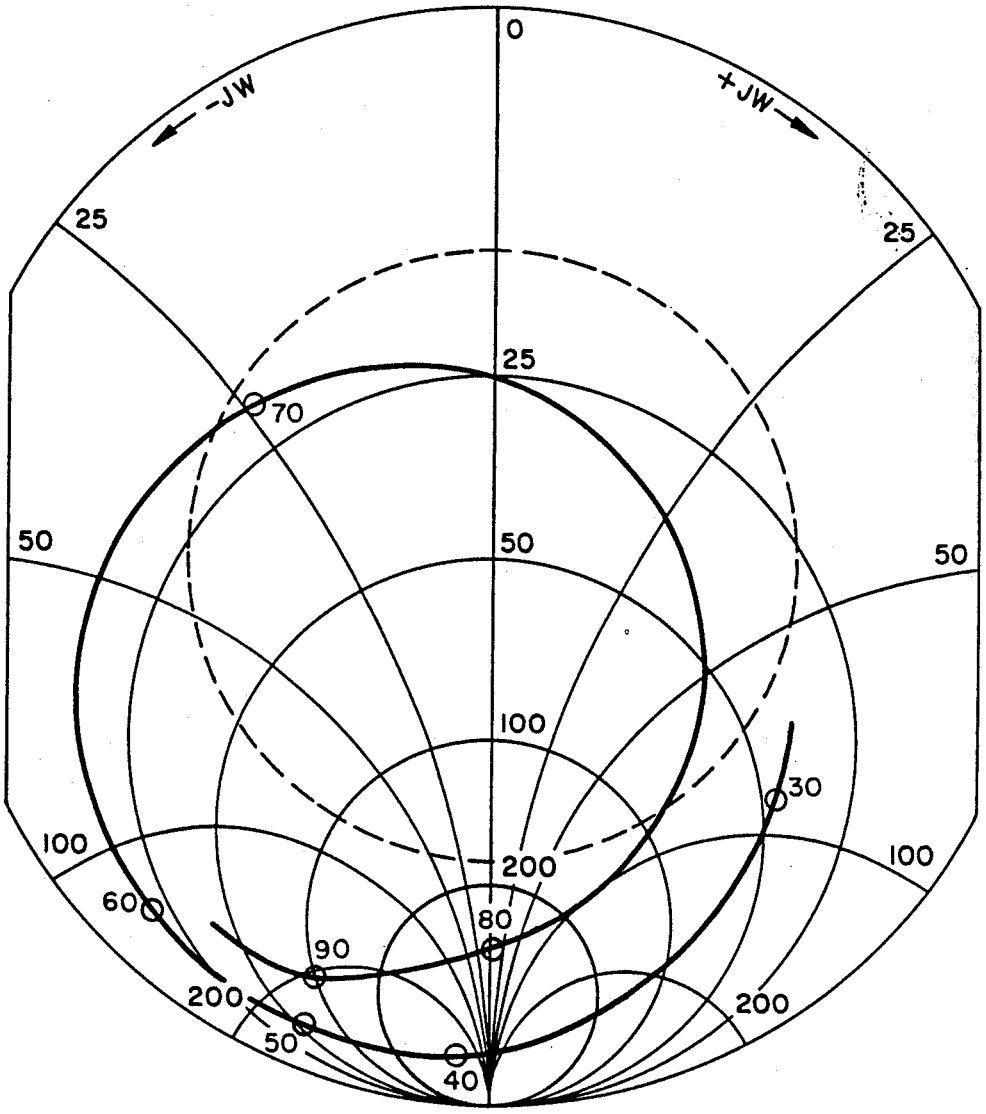
FIG. 7 is a Smith Chart plot, substantially in the same form as that of FIG. 5, depicting the impedance of a continuous linear radiator of 117″ (297.2 cm) overall physical length.

The effect of the various elements upon impedance may be most fully understood by first examining the Smith Chart impedance plot in FIG. 7 for a continuous linear radiator of 117" (297.2 cm) overall physical length and approximately ½" (1.3 cm) effective radius. It can be observed that there is a wide variation in resistance and reactance of this antenna as a function of frequency, and that it is past one-quarter wave resonance at 30 MHz, is one-half wave resonant at approximately 39 MHz, is three-quarter wave resonant at approximately 72 MHz, and passes through full wave resonance at 80 MHz.

It is well known that if such a radiator is matched at specific frequencies from 30 MHz to 90 MHz and if the radiator is longer than approximately five-eighths wavelength at any frequency, the directive gain is no longer in the azimuth plane and signal coverage is reduced. I have found that by placing a small capacitance in series with the linear radiator the apparent electrical length of the linear radiator may be reduced over the entire 30 MHz to 90 MHz band, the wide variation in resistance and reactance over the band reduced considerably, and the radiation angle kept at a minimum (maximizing signal coverage).

Figure 8:
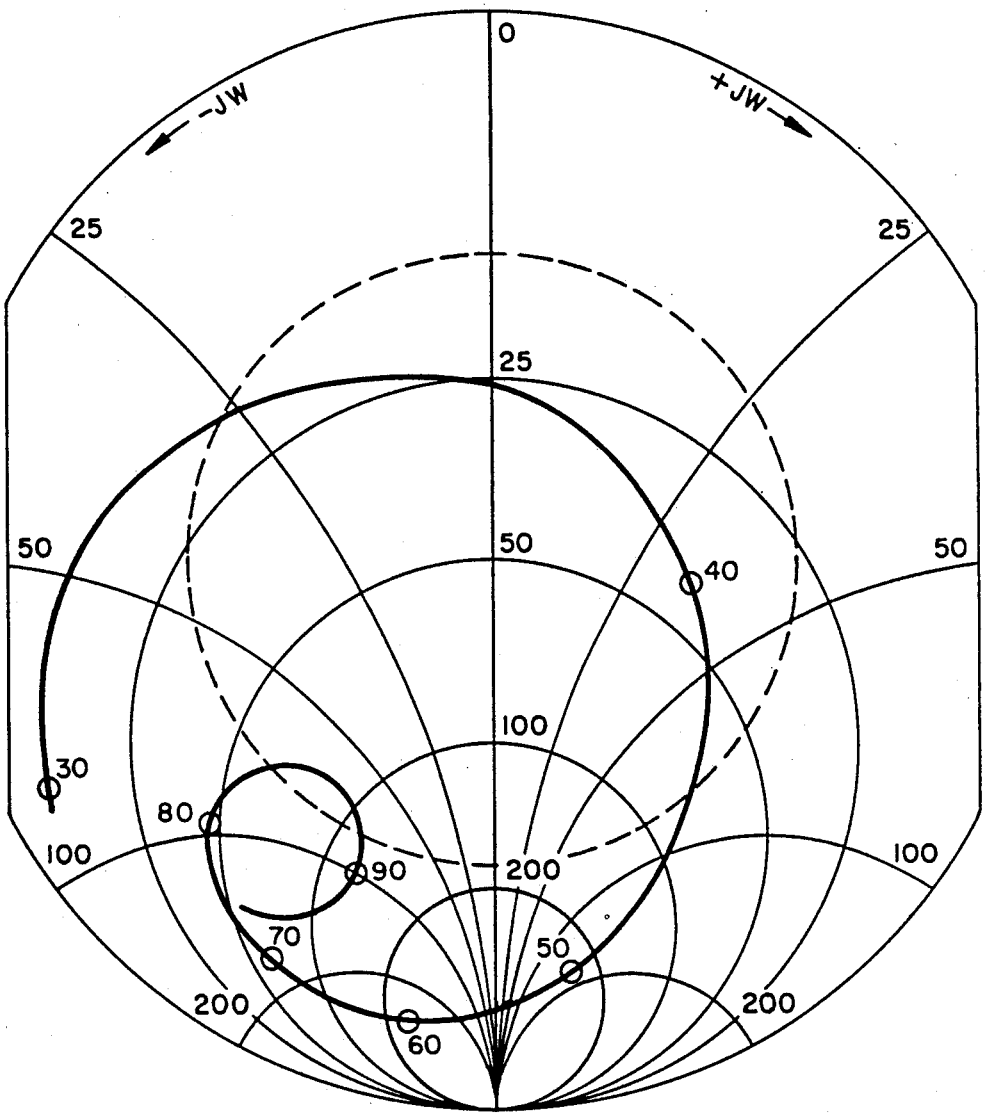
FIG. 8 is a Smith Chart plot, substantially in the same form as that of FIG. 5, depicting the impedance of the antenna, the impedance of which is plotted in FIG. 7, modified by the addition of a capacitor of approximately 5 pf inserted in series with the linear radiator at a height of 65.5″ (166.4 cm) above the ground plane.

FIG. 8 presents a Smith Chart plot of the impedance characteristics of the 117" (297.2 cm) linear radiator with a capacitor of approximately 5 pf inserted in series with the linear radiator at a height of 65.5" (166.4 cm) above the ground plane. As can be seen from FIG. 8, the linear radiator as modified is one-quarter wave resonant at approximately 38 MHz, passes through half-wave resonance at approximately 55 MHz, but has no other resonant frequencies. Using a broad band impedance transformer to transform the antenna impedance at the base of the linear radiator (which is its feed point) to that of the transmission line to which it is connected, a lower VSWR (that is, 3.5:1 or less) is achieved from approximately 59 MHz to 90 MHz, as shown in FIG. 9.

The height above ground at which the capacitor is positioned in series with the linear radiator is important to the electrical performance of the linear radiator and ultimately should be selected to balance electrical performance and mechanical considerations. I have empirically learned that where one is constructing a low-profile antenna to operate over the broad band of 30 MHz to 90 MHz, 65.5" (166.4 cm) appears optimum.

Figure 9:
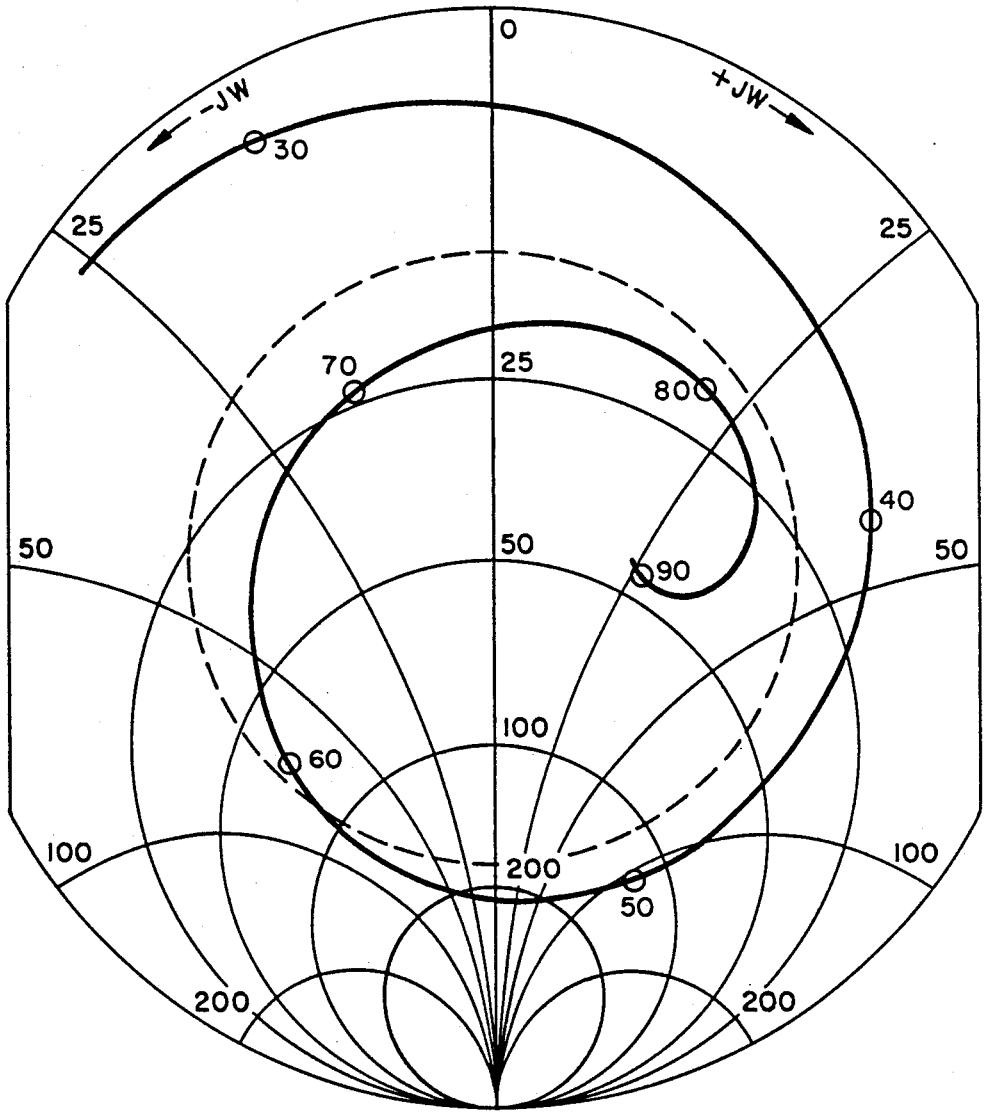
FIG. 9 is a Smith Chart plot, substantially in the same form as that of FIG. 5, depicting the impedance of the antenna, the impedance of which is plotted in FIG. 8, modified by the addition of a broad band impedance transformer.
Figure 10:
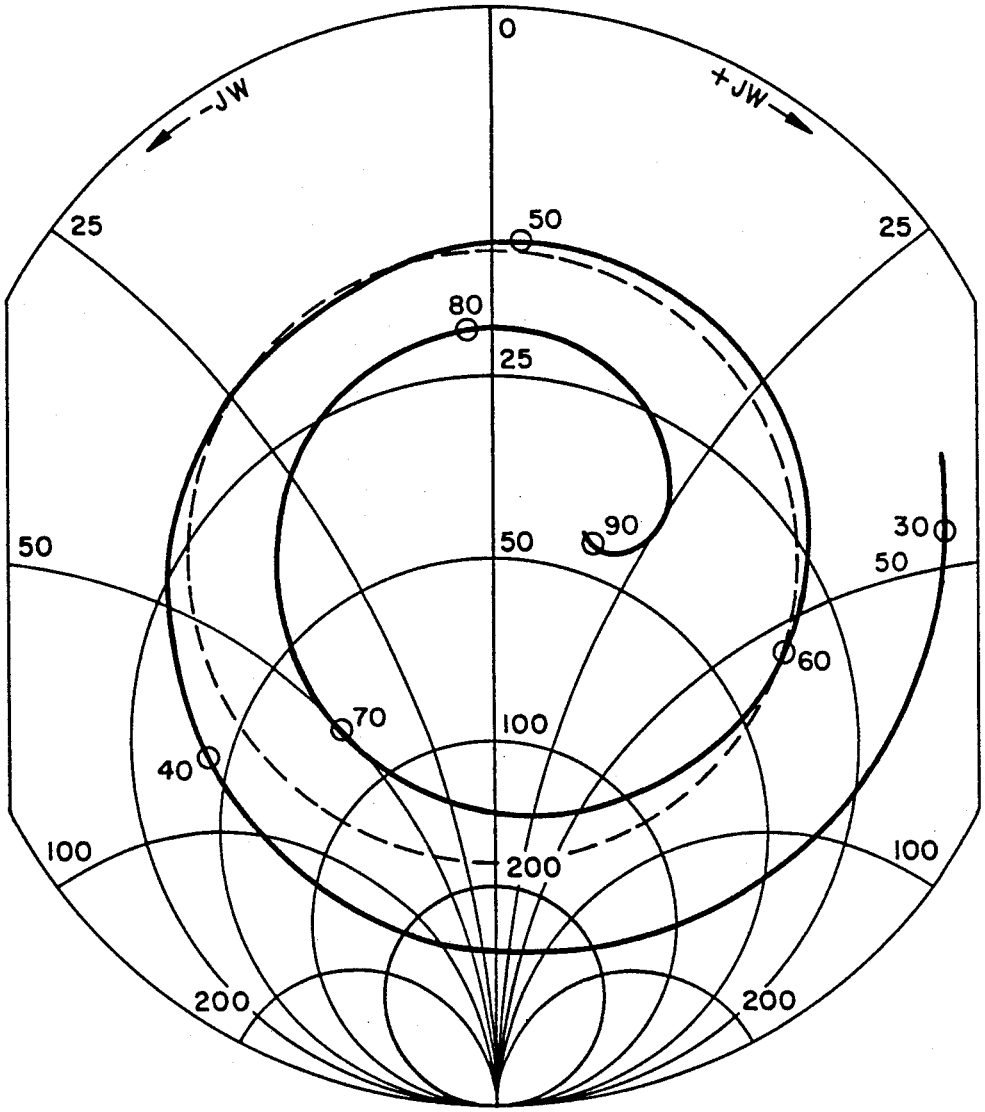
FIG. 10 is a Smith Chart plot, substantially in the same form as that of FIG. 5, depicting the impedance of the antenna, the impedance of which is plotted in FIG. 9, modified by the addition of a length of transmission line; and, FIG. 11 is a Smith Chart plot, substantially in the same form as that of FIG. 10, depicting the impedance of the antenna, the impedance of which is plotted in FIG. 10, modified by the addition of a matching capacitor.

FIG. 9 underscores that at the low end of the operating frequency band, the linear radiator including the series tip capacitor and impedance transformer has a low input resistance and a capacitive reactance. The addition of transmission line which preferably but not necessarily has the same characteristic impedance as that of the transmission feed line connected to the antenna, adds an offsetting inductive reactance, improving matching in the range of 40 MHz to 60 MHz, as depicted in FIG. 10. More importantly, this also results in the linear radiator becoming inductively reactive at low frequencies in the band. This, in turn, permits compensation by the addition of a small matching capacitance in series with the transmission line, producing the impedance plot of FIG. 11.

Figure 11:
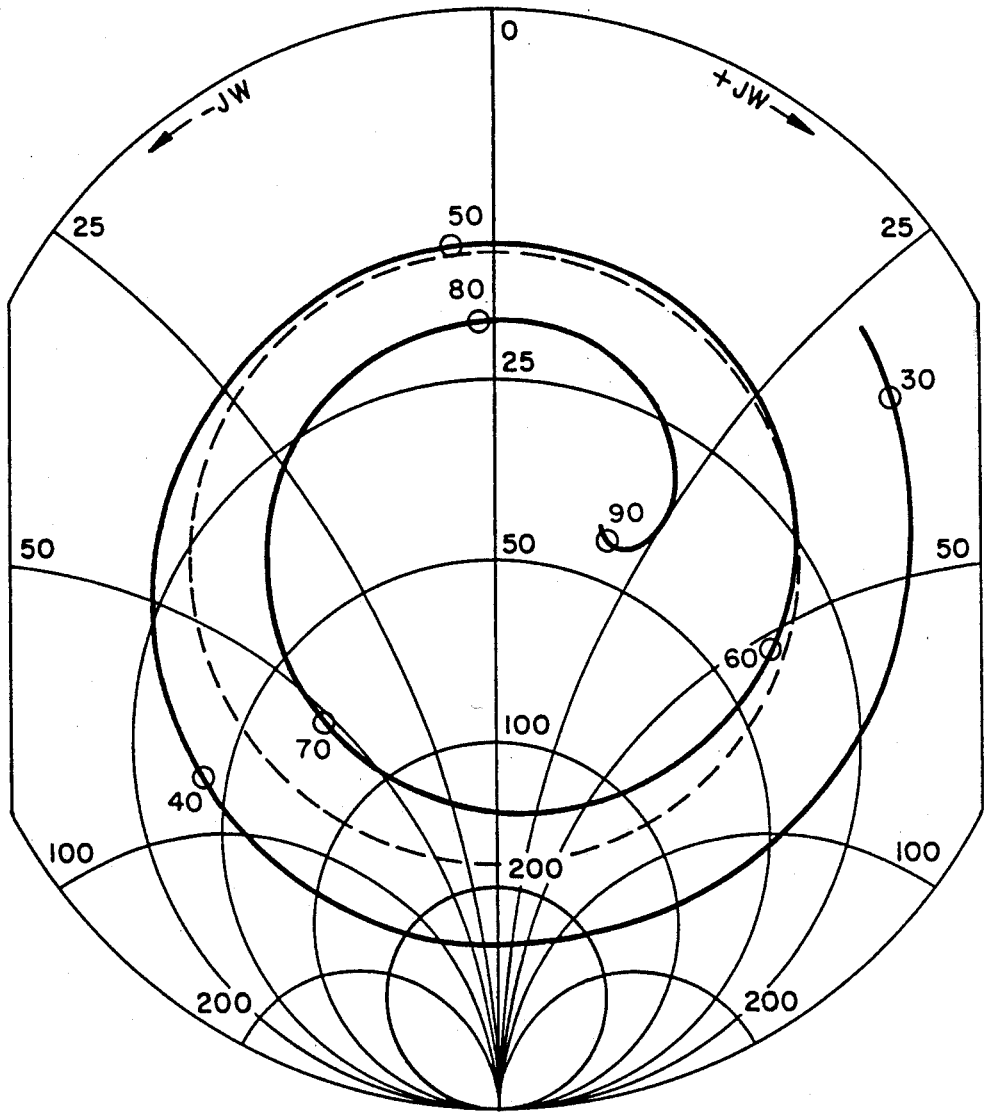

I have further discovered that by adding a small resistance in series with the linear radiator and impedance transformer, the resultant lower frequency VSWR of the antenna as depicted in FIG. 11 may be significantly reduced. In other words, this series resistance acts to increase the resistance of antenna 10 at its feed point at the lower frequencies but has little effect upon the feed point resistance at higher frequencies, thereby reducing VSWR at lower frequencies without a corresponding VSWR increase at higher frequencies. Thus, by placing a suitable resistance in series with and ahead of the transmission line network, VSWR is significantly reduced at lower frequencies in exchange for an acceptably small reduction in gain, and the spiral shaped impedance plot of FIG. 11 is pulled into the tighter spiral shown in FIG. 5, producing a low-profile antenna whose VSWR is sufficiently low across the entire band of interest that further tuning and matching is unnecessary and whose gain is not significantly reduced from that of a one-quarter wavelength antenna at each frequency across the band.

Several additional modifications to antenna 10 beyond those discussed above within the spirit of the present invention should also be noted. For example, it will be appreciated that depending upon manufacturing and application parameters, the linear radiators may be formed as a single continuous radiator or a multiple section radiator. Also, the height of resistor network 18 above ground may be changed depending on what would yield an acceptable current distribution in the frequency band of interest. Additionally, any broad band impedance matching network of suitable characteristic may be utilized in place of the toroidal impedance transformer 19.

In applications where a wider profile may be desired or tolerated, the diameter of tip radiator 11 and base radiator 13 may be increased with a slight decrease in VSWR. Where a broad band antenna is sought for operation at higher frequencies, it may be possible to eliminate or relocate into base assembly 16 tip capacitor 12 and shorten the overall length of tip radiator 11 and base radiator 13, although an increase in the resistance of resistor network 18 may be necessary to furnish adequate VSWR correction at the low end of the band of interest. As a final example, it may be possible, although it does not generally appear preferable, to relocate other series elements of antenna 10: resistor network 18 may be connected in series between transmission line 22 and ground, provided a large inductance is added in parallel therewith to substantially preclude deleterious ground currents; and, resistor network 18 may be connected between impedance transformer 19 and transmission line 22, provided lower gain is tolerable and slightly different VSWR correction is acceptable.

Inasmuch as the present invention is subject to many variations, modifications and changes in detail, a number of which have been expressly stated herein, it is intended that all matte described throughout this entire specification or shown in the accompanying drawings be interpreted as illustrative and not in a limiting sense. It should thus be evident that a device constructed according to the concept of the present invention, and reasonable thereto, will accomplish the objects of the present invention and otherwise substantially improve the low-profile, monopole broad band antenna art.

I claim:

1. A low-profile, monopole antenna operable over a predetermined broad band and connected to a transmission line, comprising:

a radiator including means for providing a series capacitance;

network means for substantially coupling and matching the impedance of the antenna with the impedance of the transmission line to which it is connected, said network means operatively connected to said radiator; and, resistance means for minimizing the antenna's voltage standing wave ratio (VSWR) over lower frequencies in said broad band to make tuning unnecessary and gain approximate that of a one-quarter wavelength monopole over substantially all frequencies in said broad band, said resistance means electrically connected in series with said radiator.

2. A low-profile, monopole antenna, as set forth in claim 1, wherein said radiator includes first linear radiator and second linear radiator operatively connected to one end of said first linear radiator, and said resistance means is electrically connected in series between said network means and the end of said second linear radiator opposite that connected to said first linear radiator.

* * * * *